United States Patent [19]

Breed

[11] 4,213,395

[45] * Jul. 22, 1980

[54] BALL ROTOR SAFETY AND ARMING DELAY DEVICE

[76] Inventor: David S. Breed, Hillcrest Rd., Boonton Township, Morris County, N.J. 07005

[ * ] Notice: The portion of the term of this patent subsequent to Jul. 4, 1992, has been disclaimed.

[21] Appl. No.: 883,307

[22] Filed: Mar. 3, 1978

Related U.S. Application Data

[63] Continuation-in-part of Ser. No. 698,806, Jun. 23, 1976, Pat. No. 4,098,192, which is a continuation-in-part of Ser. No. 470,152, May 15, 1974, abandoned, which is a continuation-in-part of Ser. No. 288,026, Sep. 11, 1972, abandoned.

[51] Int. Cl.[2] ..... F42C 15/22

[52] U.S. Cl. ..... 102/236; 102/245; 102/267

[58] Field of Search ..... 102/235, 263, 244, 245, 102/267

[56] References Cited

U.S. PATENT DOCUMENTS

| | | | |
|---|---|---|---|
| 2,458,405 | 1/1949 | Nichols | 102/236 |
| 2,924,176 | 2/1960 | Neuwirth et al. | 102/267 |
| 3,073,761 | 1/1963 | Covino | 308/DIG. 7 |
| 3,138,413 | 1/1964 | DeWoody | 308/DIG. 7 |
| 3,397,640 | 8/1968 | Ziemba et al. | 102/243 |
| 3,425,354 | 2/1969 | Carlson | 102/238 |
| 3,608,494 | 9/1971 | Ziemba | 102/235 |

OTHER PUBLICATIONS

*The Condensed Chemical Dictionary,* 1971, Van Nostrand, Reinhold Co., pp. 426, 592 and 643.

*Primary Examiner*—David H. Brown
*Attorney, Agent, or Firm*—Kane, Dalsimer, Kane, Sullivan and Kurucz

[57] ABSTRACT

The ball rotor safety and arming device of this invention includes means for rendering the friction forces which effect the alignment time of the ball rotor more reproducible and controllable reducing the dispersion of arming distances of the device and in some cases increasing the mean arming distance.

15 Claims, 6 Drawing Figures

FIG. 4
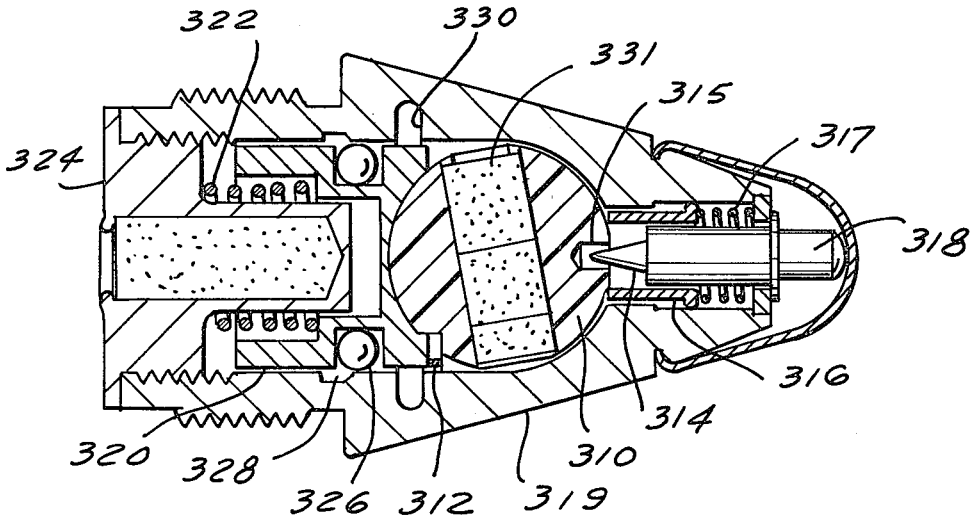
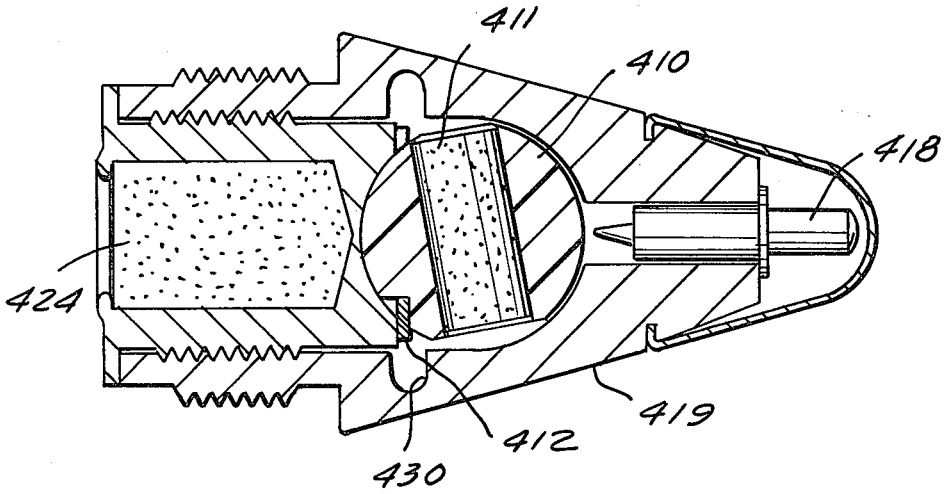
FIG. 5

BALL ROTOR SAFETY AND ARMING DELAY DEVICE

REFERENCE TO RELATED APPLICATIONS

This application is a continuation-in-part of application Ser. No. 698,806 filed June 23, 1976 now U.S. Pat. No. 4,098,192, granted July 4, 1978, which in turn was a continuation-in-part of Application Ser. No. 470,152 filed May 15, 1974 which in turn was a continuation-in-part of Application Ser. No. 288,026 filed Sept. 11, 1972 both of which are now abandoned.

BACKGROUND OF THE INVENTION

Safety and arming delay devices which comprise a ball rotor having a polar moment of inertia larger than either transverse moment of inertia have been in use since their invention in the late 1800's. In such a device the ball rotor contains an explosive element which is part of the firing train. Such a firing train usually begins with the detonator or primer and ends with the main charge of the projectile. In most cases the detonator itself is contained in the ball rotor. Prior to firing the munition the rotor is held with its polar axis at some angle, such as 60° to 80°, with the spin axis of the projectile. The explosive element contained in the ball rotor lies on the polar axis of the ball rotor thus in this condition an accidental explosion of the detonator or primer will not result in explosion of the munition. When the munition is launched, forces arising out of the difference in moments of inertia of the ball, projectile spin, and friction act in such a way as to cause the ball rotor to align its polar axis with the spin axis of the projectile. At this time the projectile is armed and an explosion of the detonator will result in an explosion of the projectile if the firing train is not broken at some other point.

Since this safety and arming device consists primarily of one moving part, its simplicity has never been equally by other safety and arming devices. For this reason a great deal of effort has been applied over the years to adapt the ball rotor to fuzing of all types of spinning projectiles. In spite of this effort, however, gear train escapements and other safety and arming delay devices have generally been used in every application except 20–30 mm. projectiles even though the cost of these safety and arming delay devices is generally two to five times higher. Ball rotor fuzing is currently being used in the 20–30 mm. projectiles because of the extreme size limitations imposed on the fuze by this projectile. Nevertheless, even in the 20–30 mm, projectiles a considerable effort has been undertaken to find a substitute for the ball rotor.

The reason ball rotor safety and arming delay devices have not found greater use in spite of the substantial research and development efforts that have been expended, lay in the wide dispersion of arming distances which have resulted and in the failure of most ball rotor systems to achieve a minimum safe arming distance. Even in the now standard M505A3 20 mm. fuze, some of the projectiles begin arming at less than 20′ and all are not armed until somewhere over 100′. When these projectiles are fired from wing located guns in high performance aircraft, some of the projectiles could be armed while very close to the nose of the plane. An accidental explosion of one of these armed projectiles could seriously damage the plane and injure the pilot.

A careful mathematical analysis supported by test firings has shown that the cause of the short arming distance is partially due to high friction forces. Similarly, the cause of the wide dispersion in arming distances is due to a wide dispersion of the magnitude and location of the friction forces acting on the ball rotor. The key to successful ball rotor fuzing, therefore, lay in reducing and controlling these friction forces. This has been accomplished by this invention.

The approach taken in the Ziemba et al Pat. No. 3,397,640 granted Aug. 20, 1968 is illustrative of an attempt to solve the problems of ball rotor safety and arming devices. This patented system proved to be unacceptable because the desired reproducibility over a temperature range of −60° F. to +160° F. could not be obtained. The viscous liquids and silicone greases contemplated and available at that time had a variation of viscosity of 35–40 to 1 over this temperature range.

SUMMARY OF THE INVENTION

This invention is primarily concerned with modifying the Coulomb friction forces which determine the time of alignment of the polar axis of a ball rotor with the spin axis of the projectile to reduce the dispersion of the arming distances and in some cases to control the location of the mean arming distance. The Coulomb friction forces are modified through one or more techniques including the use of buoyant forces exerted on the ball by a low viscosity liquid which substantially fills the ball cavity, a boundary lubricant, a solid film lubricant, a substantially enlarged clearance between the ball and its cavity, and the inclusion of known eccentricities in the ball or ball cavity.

One of the primary objects of this invention is to provide for a ball rotor safety and arming delay device having a substantially reduced distance dispersion.

Another object of this invention is to provide a ball rotor safety and arming delay device having a longer mean arming distance than heretofore possible.

A further object of this invention is to provide an acceptable safety and arming delay device for all spinning munitions.

Another object of this invention is to provide an inexpensive safety and arming delay device capable of meeting current requirements for fuzing 20–30 mm. projectiles.

Still another object of this invention is to provide an exceedingly inexpensive safety and arming delay device capable of meeting the requirements for artillery projectiles.

A further object of this invention is to provide for a low cost safety and arming delay device capable of meeting the requirements for other spinning munitions including bomblets and 40 mm grenades.

Both teachings of the Ziemba patent and the present invention result in a longer arming delay, however, for entirely different reasons. In the Ziemba patent, the ball rotor is immersed in a very viscous grease or liquid. This causes the ball rotor to always spin at an rpm which is almost identical to that of the projectile. If an observer were rotating with the projectile and looking down on the top of the ball rotor, one would see a smooth motion of the detonator from its out of the line position to a position where it is aligned with the spin axis of the projectile. The detonator in other words would not appear to be rotating around the observer. This is a very heavily damped system. In the present case, on the other hand, the same observer would watch the denonator spinning around underneath him and instead of a single smooth curve involving a total relative motion of the detonator of perhaps less than 180° relative to the projectile, he would see the detonator making many revolutions as it gradually spirals into alignment. This system does not experience significant damping from the liquid and its motion is primarily controlled by the Coulomb friction forces between the ball and its housing. In the Ziemba case, the arming distance is primarily determined by the viscosity of the fluid. In the present case, the viscosity is insignificant. In the Ziemba case, fluids are used having a viscosity in the neighborhood of 100,000 centistokes. In the present case, a typical fluid has a viscosity of approximately 1 centistoke. For some applications, fluids having somewhat higher viscosity could be used in the present case, however, but most likely not as high as 1,000 centistokes which would operate according to the teachings of the present application.

Other objects and advantages of this invention will become apparent as the description progresses.

BRIEF DESCRIPTION OF THE DRAWINGS

In the accompanying drawings in which various embodiments of the present invention are illustrated:

FIG. 4 is a sectional view 20 mm fuze with self destruct employing a Teflon (polytetrafluoroethylene) coated rotor ball; and FIG. 5 is a sectional view of another 20 mm fuze employing a Teflon coated rotor ball.

DESCRIPTION OF THE PREFERRED EMBODIMENTS

Figure 1A:
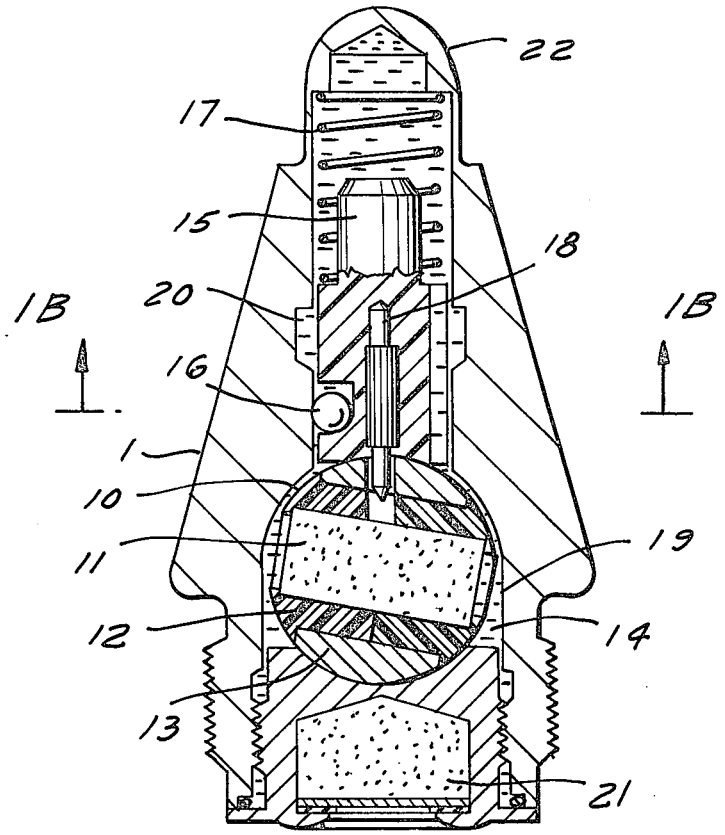
FIG. 1A is a section view of a fuze applicable to 20–30 mm projectiles.
Figure 1B:
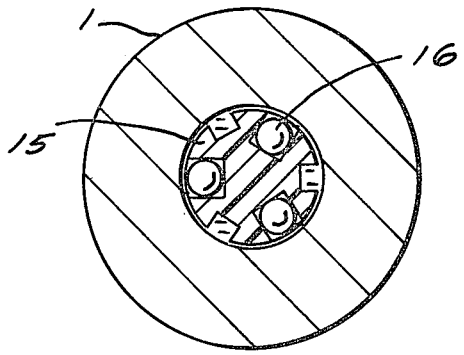
FIG. 1B is a section view along line 1B—1B of the fuze of FIG. 1A.

Referring now to the drawings, a fuze containing a ball rotor safety and arming delay device constructed in accordance with the teachings of this invention is shown as 1 in FIG. 1. A ball rotor 10 is contained in a cavity in the body 19. A detonator assembly 11 is placed on the polar axis of the ball rotor 10 which in turn is placed at 80° angle with respect to the spin axis of the fuze. The ball rotor is held at this angle by the firing pin 18 which is in turn held in a plastic piston 15 which is urged toward the ball rotor by spring 17. The remainder of the fuze cavity is filled with a high density fluid having a specific gravity of about 2.4. The fluid is preferably of relatively low viscosity as discussed in the above. The ball rotor 10 also contains a plastic portion 12 and a steel portion 13. This construction results in a ball rotor assembly having a polar moment of inertia which is substantially larger than the transverse moments of inertia and a density which is only slightly greater than that of the surrounding fluid. For this case, for example, the average specific gravity of the ball rotor is between 3 and 4. The effective weight of the ball rotor, in this case, therefore, is substantially less than the ball rotor used in the M505 20 mm fuze which aside from the detonator is constructed entirely of steel.

When the projectile is fired the entire fuze, and all of its parts, receive a substantial acceleration which in some cases is equal to or exceeds 100,000 g's, where g is the acceleration of gravity. This acceleration greatly increases the buoyant force on the plastic piston 15 which in fact becomes so great than the spring 17 is no longer sufficient to hold the plastic piston and the firing pin in the position shown in FIG. 1. The piston therefore moves to the front of the fuze removing the firing pin from locking the ball rotor. At the same time the projectile is experiencing a significant angular acceleration. The resulting angular velocity puts a centrifugal force on three lock balls 16 which move radially outward into groove 20. When the projectile leaves the gun and the acceleration ceases these centrifugal forces are sufficient to prevent piston 15 from moving toward the rear of the fuze.

A combination of dynamic forces arising out of the difference in the polar and transverse moments of inertia of the ball rotor and friction forces now come in to play to cause the ball rotor to move in such a way as to align its polar axis with the spin axis of the projectile. At this point the fuze is considered armed and the detonator assembly 11 is in line with the firing pin 18 and the booster 21. If the projectile strikes a target in this condition, the nose of the fuze 22 will collapse forcing piston 15 and firing pin 18 into detonator assembly 11 which explodes and initiates booster 21 which in turn sets off the high explosive in the projectile.

The friction forces play a critical role in determining the arming distance of the projectile. If no friction forces are present the ball rotor will continue indefinitely oscillating near its initial angular location with respect to the spin axis. Similarly, if the friction forces are too large, the ball can become frozen in its initial position and also never move so that its polar axis becomes aligned. The key, therefore, to understanding the operation of the ball rotor lay in a careful analysis of the friction forces coupled with the basic dynamics equations. An outline of such an analysis is provided below.

The friction forces which act on the ball result from deceleration of the projectile, static and dynamic unbalance of the projectile, unbalance of the ball rotor, precession and nutation of the projectile, and the clearance between the ball and the cavity. A careful analysis has indicated that for most projectiles the drag, nutation and precession induced forces are small. Forces arising from unbalance in the ball and from the ball socket clearance are controllable at the time of manufacture and can be made either small or large. Finally, the forces arising from static and dynamic unbalance of the shell are significant and cannot easily be eliminated at the time of manufacture. The mere act of firing a projectile itself induces eccentricities in the shell due to unequal engraving of the rotating band. It is thus these latter forces which are the major contributing factor to the variation in the total friction force acting on the ball rotor and which must be reduced both absolutely and in relation to the other friction forces and dynamic torques.

A computer solution of the dynamics equations has demonstrated that if all of the friction forces on the ball are kept small and if the shell eccentricity also is very small an exceedingly large arming distance will result. If the shell eccentricity is substantially increased, however, the arming distance will become very short if the eccentricity is located such that the ball contacts its housing at a point which coincides with a transverse axis of the ball. However, if the ball contacts its housing at a point which is 90° away from the transverse axis, an exceedingly long arming distance will result. Thus, it is not only the magnitude of the shell unbalance which is important, but also its location with respect to the principal axes of inertia of the ball rotor. Since both the magnitude and location of this eccentricity cannot easily be controlled, the total friction force arising from this cause must be reduced relative to the other friction forces and dynamic torques.

In the fuze of FIG. 1, all of the friction forces have been reduced by utilizing a ball rotor which has an average density only slightly larger than that of the surrounding fluid. This fluid thus exerts a buoyant force on the ball rotor and thus substantially reduces its effective weight. All of the friction forces are proportional to the effective weight of the ball rotor and thus all of the friction forces are reduced proportionally. It has been found that a fuze designed and tested according to the above description results in substantially improved arming distance dispersion, however, the arming distance is somewhat long for the requirements of the 20–30 mm. fuze. Additional computer analysis and experimentation aimed at artificially increasing one or more of the friction forces has indicated that increasing the clearance between the ball and its socket has the most favorable effect and in fact, reduces the dispersion in arming distances further and reduces the mean arming distance to meet the requirement. The nominal radial clearance in the standard M505A 3 fuze is approximately 0.002". In the improved fuze of FIG. 1, this clearance has been increased to approximately 0.016".

The fluid used is one of a series of standard brominated fluids such as manufactured by Dow Chemical Corporation of Midland, Michigan and Halocarbon Corporation of Hackensack, New Jersey. Such fluids are available with densities ranging from one to over three. A small amount of a fatty acid has been added to this fluid to increase its boundary lubrication properties to further reduce the friction forces through reducing the coefficient of Coulomb friction. Even with the use of a lubricant, the viscous forces are negligible. The particular fatty acid used is oleic acid, however, a wide variety of boundary lubricating additives could be used which are well known to lubrication engineers. In addition, other solid film lubricants could be applied to the surfaces of the ball or its socket to further reduce the coefficient of friction. In some applications where shorter arming times are permissible or where a larger ball could be used, the fluid could be eliminated altogether with the friction forces being reduced through the use of a solid film lubricant such as Teflon (polytetrafluoroethylene), Molybdenum disulfide, or graphite. In such cases, the same principles which are described herein would apply wherein the uncontrollable friction torques are reduced in comparison to the dynamic torques. Where a larger ball rotor could be used the dynamic torques could be increased substantially permitting higher friction forces to be present and eliminating the need for the buoyant fluid.

In many applications it is desirable to practice this invention without resorting to the use of a liquid. In such cases a film of solid lubricant has been successful alone. In early attempts using a very thin coating of powdered graphite, inconclusive results were obtained and these test efforts were abandoned. Extensive testing has since revealed that the solid film lubricant must be applied in a coating with a significant film thickness. It has been found that to achieve the results of this invention, that the film thickness must be at least 0.0001 inches.

Figure 2:
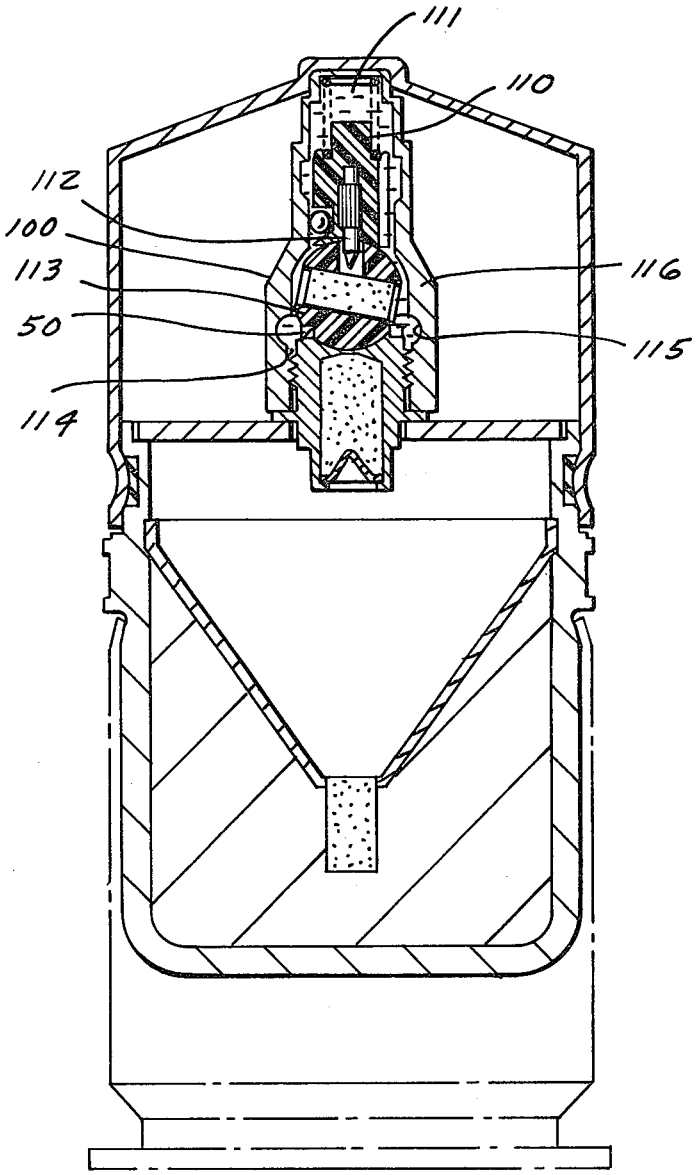
FIG. 2 is a cross-section view of a 40 mm shape charge grenade.

A second preferred embodiment constructed in accordance with the teachings of this invention applied to a 40 mm. shape charge grenade is shown at 100 in FIG. 2. The operation of this ball rotor safety and arming delay device is similar to the one described above. Upon setback the firing pin assembly 110 moves to the front of the fuze due to buoyant forces from the fluid 111 removing the firing pin 112 from the ball rotor 113. In this fuze a second spin lock ring 114 has been provided to add an additional safety feature to the fuze. After setback, this ring moves outward into a recess 115 in the housing 116 due to centrifugal forces. When the firing pin 112 and spin lock 114 are removed, the ball rotor 113 rotates into alignment under the friction forces described above. In this fuze once again fluid has been used to reduce the effective weight of the ball rotor without affecting its moments of inertia, thus all friction forces are reduced while the dynamic torques remain the same. Once again a larger clearance has been used to provide a controllable friction force. In this case, the clearance is somewhat larger in order to reduce the arming distance to the desired value.

Figure 3:
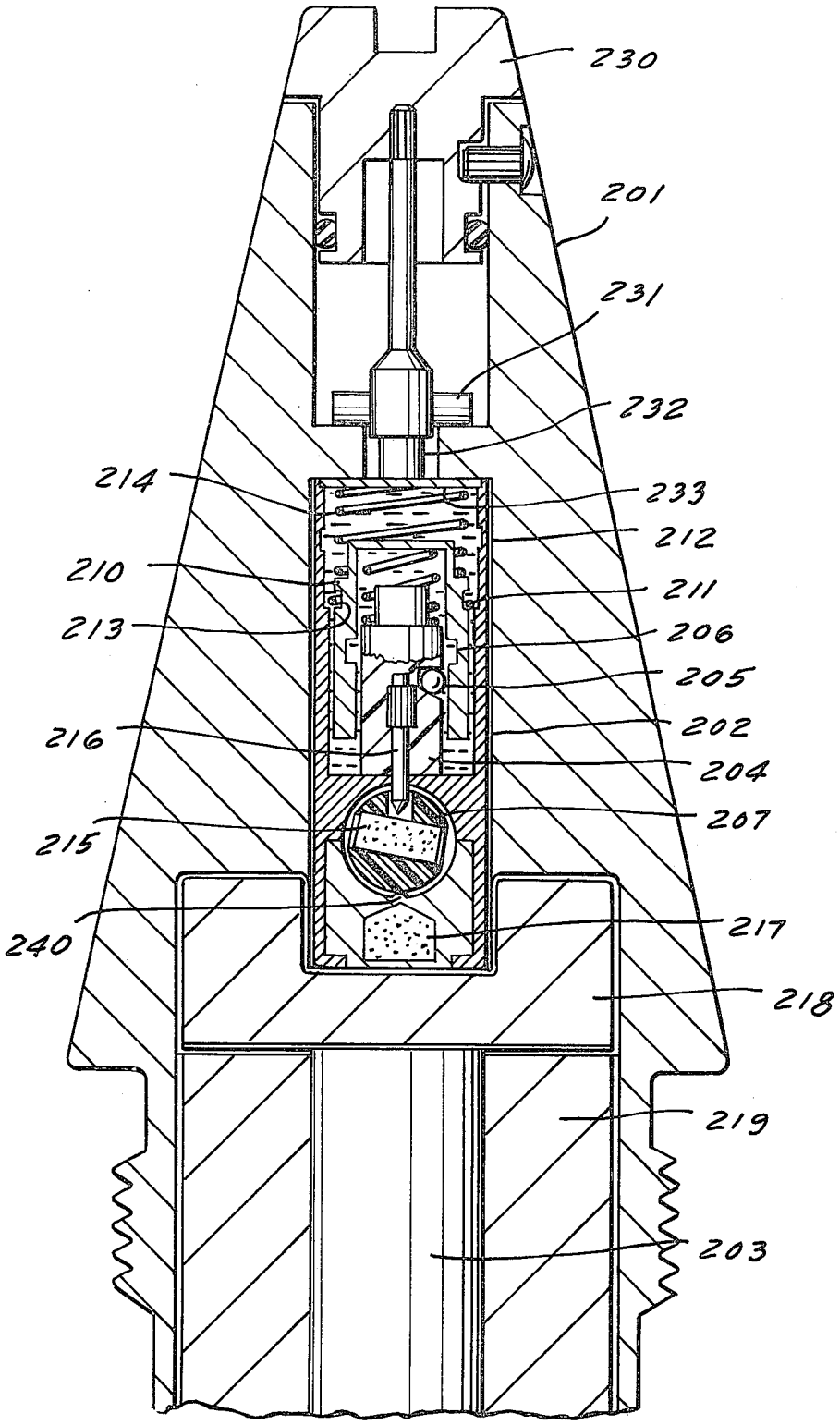
FIG. 3 is a partially sectioned view of an artillery fuze containing two safety and arming delay mechanisms.

A fuze constructed utilizing a safety and arming delay device according to the teachings of the present invention applied to artillery is illustrated at 201 in FIG. 3. Two safety and arming delay devices shown generally at 202 and 230 are utilized in a redundant fashion in this fuze. The operation of the arming portion of the safety and arming delay device is similar to that described above. Upon experiencing setback acceleration, firing pin assembly 204 moves upward until lock ball 205 is forced into groove 206 by a combination of setback and spin forces. This releases ball rotor 207 which rotates into alignment in the manner similar to that described above. This fuze provides the additional feature of a super quick or delay setting by setting plug 230. In the position shown in FIG. 3, the fuze is set for delay operation. In this case when the projectile strikes the target, impact mass 210 moves toward the front of the fuze until lock ring 211 reaches lock ring groove 212 at which time it moves radially out of lock ring groove 213. At the cessation of the impact deceleration, impact mass spring 214 propels the impact mass 210, and thus the firing pin 216, toward the aligned detonator 215. The firing pin strikes the detonator which explodes into the booster 217 which ignites the larger boosters 218 and 219 respectively and such a manner sets off the high explosive in the artillery shell.

If the setting plug 230 is rotated 90° prior to firing of the projectile, pin 231 becomes aligned with a parallel slot (not shown) such that upon impact plunger 232 is driven through end 233 of the safety and arming delay device 202 and drives the impact mass and firing pin combination toward the detonator 215 setting off the round in the manner described above.

Two safety and arming delay devices have been used in this third example which illustrates the fact that when the friction forces can be controlled in ball rotor fuzing, the size of the safety and arming delay device can be made sufficiently small to permit redundant use of the device within a single fuze. In the fuze illustrated in FIG. 3, the safety and arming delay device 203 will fire in the delay mode regardless of the setting of the fuze. It thus serves as a redundant backup for the main safety and arming delay device 202. If it is not desired to utilize two such devices in a given fuze, a single ball rotor safety and arming delay device could be constructed sufficiently large to eliminate the need for the fluid to be used to reduce friction forces. In come cases if the shell eccentricities are controlled, it would be possible to even eliminate the need for the density reducing plastic used in the ball described in FIG. 1. For such a case, low friction coefficients could be achieved by utilizing a careful choice of materials on the surface of the ball and its cavity.

For most cases studied the preferrable controllable friction forces has proven to be the clearance between the ball and its cavity. The other controllable friction force would be the unbalance in the ball rotor which could be controlled by removing portions of the ball to displace the center of mass of the ball from its geometric center. The eccentricity of the entire safety and arming delay device could of course be increased which would have the same effect as shell eccentricity, however, its magnitude and location could be controlled and thus not subject to variation from round to round. For all of the cases studied however, this other controllable friction force has not resulted in as tight a dispersion as achievable through increasing the ball socket clearance. It has resulted however, in an improvement in the arming distance dispersion over the standard ball rotor fuzes utilized to date.

In this application a somewhat longer arming distance has been achieved by supporting the ball rotor on a small support 240. This reduces the friction torques which normally brings the ball up to the projectile angular velocity at setback. In this case, therefore, the angular velocity of the ball is substantially below that of the projectile when the projectile leaves the muzzle of the gun. A computer analysis has shown that the ball rotor does not begin to align until it approaches the same angular velocity as the projectile. In this fuze the arming distance was approximately doubled by this technique. The presence of the fluid between the ball and its housing delays the spin-up of the ball due to hydrodynamic bearing forces arising from the relative rotation of the ball and socket. The housing of course could be designed to maximize or minimize this effect by those skilled in the art of hydrodynamic bearing design.

In other applications such as that shown in FIG. 1, the arming distance would be too long if the ball does not achieve a significant portion of the projectile angular velocity. For this case therefore a tab 50 (see FIG. 2) has been provided to lock the ball to the shell during setback. This tab 50 is removed by centrifugal forces after the ball has achieved a significant angular velocity.

Referring now to FIG. 4, a 20 mm fuze having a self-destruct mechanism is shown with a dry lubricant being employed in the form of a Teflon* coating on the rotor ball 310. The rotor ball 310 is contained in the cavity of the body 319 and its detonator assembly 331 is placed on the polar axis of the ball which in turn is placed at approximately an 80° angle with respect to the spin axis of the fuze. This orientation is maintained by means of the cooperation of the horse-shoe or C-clip 312 and with the firing pin 318 having its detonator striking end 314 disposed in accommodating recess 315 of the ball 310. A bias sleeve 316 and bias spring 317 is disposed as shown.

*Teflon is a Trademark of Dupont As will be apparent shortly, the biased sleeve 316 holds the ball 310 in retracted position off of the firing pin 318 during setback. In this connection when the projectile with the fuze of this embodiment is launched, the setback sleeve 320 will move rearwardly against setback spring 322 both of which are telescoped over the booster assembly 324. When this occurs the detent balls 326 would likewise move rearwardly and the generated centrifugal forces incident to the spinning of the projectile will cause the detent balls 326 to be disposed in the recess 328. When the projectile leaves the launching barrel and incident to the spinning thereof, the C-clip 312 will expand and be disposed in the recess 330 as a result of the rearward movement of the rotor ball 310 when subjected to setback forces. When this occurs, the ball 310 is free to move and as in the case of the previous embodiment and in accordance with the present invention, the polar axis of the ball will align with the spin axis of the projectile. The detonator assembly 331 is then in line with the firing pin 318 and the charge of the booster 324. When projectile strikes a target in this condition, the nose of the fuze will collapse forcing the firing pin 318 into the detonator assembly 311 which explodes and ignites the charge of the booster 324 which in turn sets off the high explosive in the projectile. Following launch, the centrifugal forces experience decay such that the balls 326 will ride against the incline cam face forming part of the recess 328. If the projectile does not detonate within a predetermined period of time, the setback spring 322 will force the detonator 311 into the firing pin 318 to cause self-destruction of the projectile.

The embodiment of FIG. 5 also employs a dry lubricant in the form of a Teflon coating on the rotor ball 410 disposed in the body 419 with its detonator assembly 411 maintained in an unarmed position by means of the C-clip 412. When the projectile is launched the spin on the projectile causes the C-clip to expand into the recess 430 thereby permitting the ball 410 to move permitting the detonator 411 to align with the firing pin 418. When the projectile strikes a target, the firing pin will strike the detonator 411 causing it to explode and ignite the booster 424 which sets off the high explosive in the projectile.

The mathematical analysis of the ball rotor can be carried out of those skilled in computer programming and dynamics analysis. The basic equations to be solved are the Euler equations as presented in Goldstein, H., *Classical Mechanics,* Chapter 4–5. Reading: Addison Welsley, 1950. These equations can be integrated in a time step simulation type analysis utilizing, for example, numerical techniques described in Ralston, A., *A First Course in Numerical Analysis,* Chapter 5. New York: McGraw-Hill Inc., 1965.

According to the present invention predictable arming of a ball rotor fuze is most effectively attained by controlling the unbalance and eccentricities in the shell and ball housing and the effect thereof on the ball. Towards this end, substantially all friction forces between the housing cavity and the ball contained therein have been reduced for purposes of the present invention. In this manner, the ball has increased freedom and ability to revolve relative to the spin of the projectile because of the minimization of the effect of static and dynamic unbalance. The freedom of movement of the ball rotor is obtained by introducing a low viscosity material in certain applications and a dry lubricant for other applications.

Thus the numerous aforementioned objects and advantages among others are most effectively obtained. Although several preferred embodiments and applications have been described, discussed, illustrated above it should be understood that this invention is in no sense limited thereby but its scope is to be determined by that of the appended claims.

I claim:

1. A safety and arming delay fuze for spinning munitions comprising a housing, a cavity in said housing, a ball rotor in said cavity having a polar moment of inertia larger than either transverse moment of inertia, an explosive material within said ball rotor, firing means in said housing to ignite the explosive material, means to hold said ball rotor in a first safe position with said explosive material out of alignment with said firing means and to release said ball rotor when the munition is launched, means for increasing minimum arming distance by reducing substantially all friction forces between the walls of said cavity and the ball rotor so as to minimize the effects of forces resulting from static and dynamic unbalance of the munition and consequently the variation in the total friction forces acting on the ball rotor that would otherwise result in a wide dispersion of arming delays, such that as the munition rotates after launch, the explosive material revolves relative to the munition about the axis of the munition for many revolutions and eventually spirals into alignment with the firing means thereby providing longer minimum arming delays for the fuze with the revolving motion of the explosive material being controlled primarily by the friction forces at the point of contact of the cavity by the ball rotor.

2. The invention in accordance with claim 1, wherein said arming distance increasing means comprises the use of a nominal radial clearance between the ball rotor and its housing greater than 0.004".

3. The invention in accordance with claim 1, wherein the average density of the ball rotor is reduced through the inclusion of a low density material.

4. The invention in accordance with claim 3, wherein said material is a plastic.

5. The invention in accordance with claim 1, wherein said arming distance increasing means comprises a solid film lubricant.

6. The invention in accordance with claim 5, wherein said solid film lubricant is a polytetrafluoroethylene coating.

7. The invention in accordance with claim 5, wherein said lubricant is molybdenum disulfide.

8. The invention in accordance with claim 5, wherein said lubricant is graphite.

9. A safety and arming delay fuze for spinning munitions comprising a housing, a cavity in said housing, a ball rotor in said cavity having a polar moment of inertia larger than either transverse moment of inertia, a detonator within said ball rotor, a firing pin in said housing, first means to hold said ball rotor in a first safe position with said detonator out of alignment with said firing pin and to release said ball rotor when said munition is launched, second means for increasing minimum arming distance by reducing substantially all friction forces between the walls of said cavity and the ball rotor so as to minimize the effects of forces resulting from static and dynamic unbalance of the munition and consequently the variation in the total friction forces acting on the ball rotor that would otherwise result in a wide dispersion of arming delays, said second means being free of any viscosity effects and comprising a dry film lubricant, said second means being so constructed and arranged that as the munition rotates after launch, the detonator revolves relative to the munition about the axis of the munition for many revolutions and eventually spirals into alignment with the firing pin thereby providing longer minimum arming delays for the fuze with the revolving motion of the detonator being controlled primarily by the friction forces between the cavity and the ball rotor.

10. The invention in accordance with claim 9, wherein said solid film lubricant is a polytetrafluoroethylene coating.

11. The invention in accordance with claim 9, wherein said lubricant is molybdenum disulfide.

12. The invention in accordance with claim 9, wherein said lubricant is graphite.

13. The invention in accordance with claim 9, wherein said arming distance increasing means comprises the use of a nominal radial clearance between the ball rotor and its housing greater than 0.004".

14. The invention in accordance with claim 9, wherein the average density of the ball rotor is reduced through the inclusion of a low density material.

15. The invention in accordance with claim 14, wherein said material is a plastic.

* * * * *

UNITED STATES PATENT AND TRADEMARK OFFICE

CERTIFICATE OF CORRECTION

PATENT NO. : 4,213,395

DATED : July 22, 1980

INVENTOR(S) : David S. Breed

It is certified that error appears in the above-identified patent and that said Letters Patent is hereby corrected as shown below:

On the title page: under [76]

"Notice:" should read

--The portion of the term of this patent subsequent to July 4, 1995, has been disclaimed.--

Signed and Sealed this

Fourteenth Day of September, 1993

Bruce Lehman

*Attest:*

BRUCE LEHMAN

*Attesting Officer*

*Commissioner of Patents and Trademarks*